United States Patent [19]

Kuhn

[11] Patent Number: 4,806,079

[45] Date of Patent: Feb. 21, 1989

[54] APPARATUS FOR SIMULTANEOUSLY PUMPING A PLURALITY OF LIQUIDS

[75] Inventor: Wolfgang Kuhn, Schloss Holte-Stukenbrock, Fed. Rep. of Germany

[73] Assignee: Kopperschmidt-Mueller GmbH & Co. KG, Bielefeld, Fed. Rep. of Germany

[21] Appl. No.: 940,623

[22] Filed: Dec. 11, 1986

[30] Foreign Application Priority Data

Dec. 13, 1985 [DE] Fed. Rep. of Germany ..... 3544016

[51] Int. Cl.[4] ..... F04B 17/00; F04B 9/08; F04B 23/04

[52] U.S. Cl. ..... 417/343; 417/387; 417/429; 92/13.2; 92/13.8; 92/101

[58] Field of Search ..... 417/343, 385, 386, 387, 417/429, 470, 383, 388, 533; 92/101, 94, 13.2, 13.8, 85 R, 13.51

[56] References Cited

U.S. PATENT DOCUMENTS

| | | | |
|---|---|---|---|
| 3,043,227 | 7/1962 | Everett | 92/13.51 |
| 3,053,235 | 9/1962 | Hager | 92/85 R |
| 3,168,011 | 2/1965 | Baumann | 92/13.8 |
| 3,320,211 | 7/1967 | Faro et al. | 417/361 |
| 3,330,211 | 7/1967 | Faro et al. | 417/403 X |
| 3,350,190 | 10/1967 | Piel | 417/403 |
| 3,499,387 | 3/1970 | Zippel | 92/13.8 |
| 3,769,879 | 11/1973 | Lofquist, Jr. | 417/386 |
| 3,779,669 | 12/1973 | Sommer | 417/387 |
| 4,231,723 | 11/1980 | Spühl | 417/429 |
| 4,462,764 | 7/1984 | Van Zandt | 417/403 |

FOREIGN PATENT DOCUMENTS

| | | | |
|---|---|---|---|
| 1453597 | 5/1969 | Fed. Rep. of Germany . | |
| 1528599 | 4/1975 | Fed. Rep. of Germany . | |
| 3031067 | 4/1981 | Fed. Rep. of Germany . | |
| 3233987 | 3/1984 | Fed. Rep. of Germany . | |
| 1350149 | 12/1962 | France | 417/389 |
| 1202877 | 8/1970 | United Kingdom . | |

*Primary Examiner*—Carlton R. Croyle
*Assistant Examiner*—Leonard P. Walnoha
*Attorney, Agent, or Firm*—Peter K. Kontler

[57] ABSTRACT

Apparatus for simultaneously pumping two or more different liquids to a spraying device has a pair of discrete diaphragm pumps for each liquid. The pumps of each pair are connected in parallel and operate alternatingly so that one pump delivers a metered quantity of liquid while the pumping chamber of the other pump receives a metered quantity of the same liquid and vice versa. The capacities of pumps of at least one pair are adjustable in a simultaneous operation, and all pumps are operated by a common prime mover.

21 Claims, 5 Drawing Sheets

APPARATUS FOR SIMULTANEOUSLY PUMPING A PLURALITY OF LIQUIDS

BACKGROUND OF THE INVENTION

The invention relates to improvements in apparatus for simultaneously pumping two or more different liquids, such as paints, lacquers, resins and/or others More particularly, the invention relates to improvements in apparatus of the type wherein several individual pumps are operated alternatingly, i.e., one of the pumps displace a liquid while the other pump is in the process of drawing liquid from a source and vice versa German Offenlegungsschrift No. 30 31 067 of Clements discloses a pumping apparatus with two discrete diaphragm pumps wherein the plungers which actuate the membrane-like pumping elements are reciprocated in working cylinders by the adjacent ends of the piston rod of a pneumatic axial piston motor or by an eccentric disposed between two rod-like members each of which carries one of the plungers. One of the working cylinders is accessible and can be adjusted axially at the exposed front side of the apparatus in order to change the capacity (rate of delivery) of the respective pump in response to shifting of an opening or port which serves to connect the respective cylinder with a reservoir for a supply of hydraulic operating fluid. This results in a change of the ratio of the two liquids which are delivered by the diaphragm pumps. If such an adjusting device is provided, the membrane of the corresponding diaphragm pump cannot be mounted in a position of coaxiality with the respective plunger; the housing of the apparatus is then provided with a lateral extension for such membrane Each of the diaphragm pumps serves for delivery of a different liquid, e.g., a paint, a resin or a lacquer. The ratio of liquids can be altered in the aforementioned way, i.e., by adjusting the cylinder for the plunger which actuates the pumping element (membrane) in one of the diaphragm pumps. The two pumps operate alternatingly, i.e., one of the pumps delivers a metered quantity of a first liquid while the other pump is in the process of drawing a metered quantity of a second liquid from the respective source, and vice versa. In other words, metered quantities of first liquid are delivered to a consumer (e.g., to a spraying device) during spaced-apart intervals of time which alternate with the intervals of delivery of metered quantities of the second liquid. Such mode of operation is not satisfactory for a number of purposes, e.g., for applying a mixture of two liquids to a surface which is to be coated and/or otherwise treated. Therefore, metered quantities of the two liquids must be delivered first into a mixing vessel in order to ensure that the object which is to be provided with a coat containing the two liquids will invariably receive a proper mixture of liquids. Otherwise, the composition of a paint containing several components would be unsatisfactory, or the hardening or setting of a lacquer wold not progress in the desired way.

Apparatus for simultaneous pumping of two liquids, each by a single pump, are further disclosed in U.S. Pat. No. 3,330,211 to Faro et al. and in British Pat. No. 1,202,877 to Horsford et al. German Offenlegungsschrift No. 32 33 987 of Roser discloses an apparatus wherein several diaphragm pumps are installed in a common housing. U.S. Pat. No. 3,499,387 to Zippel discloses a plastic injection machine wherein four liquid plastic material components are delivered by four discrete pumps. German Offenlegungsschrift No. 14 53 597 of Burgert discloses an adjustable diaphragm pump, and German Auslegeschrift No. 15 28 599 discloses a plunger which carries a seal so as to reduce leakage of conveyed fluid at elevated pressures

OBJECTS AND SUMMARY OF THE INVENTION

An object of the invention is to provide a novel and improved pumping apparatus which can simultaneously deliver metered quantities of several liquids at a desired rate.

Another object of the invention is to provide an apparatus wherein the ratio of quantities of delivered liquids can be adjusted in a simple and time-saving manner.

A further object of the invention is to provide the apparatus with novel and improved means for simultaneous delivery of several liquids to a desired location in the form of substantially continuous streams rather than in a pronouncedly pulsating fashion.

An additional object of the invention is to provide a novel and improved operative connection between a prime mover and the individual pumps of the above outlined apparatus.

Still another object of the invention is to provide a novel and improved method of delivering two or more substantially continuous streams of different liquids to a selected location without the need for any mixing of such liquids ahead of the selected location.

A further object of the invention is to provide the apparatus with novel and improved means for changing the capacities of individual pumps in a simple, predictable and time-saving manner.

Another object of the invention is to provide an apparatus wherein several individual pumps can use a common pumping element to thus reduce the cost and the space requirements of the apparatus.

An additional object of the invention is to provide the apparatus with novel and improved means for synchronizing the operation of more than two pumps.

The invention is embodied in an apparatus for simultaneous delivery of metered quantities of a plurality of liquids (e.g., two different liquids). The apparatus comprises a plurality of pump units, at least one for each liquid and each comprising a first and a second pump. The first and second pumps of each pump unit operate alternatingly and are connected in parallel (i.e., one of the pumps draws liquid from a source while the other pump delivers a metered quantity of pressurized liquid, and vice versa). The apparatus further comprises a prime mover (e.g., a pneumatic motor), operating means for connecting the pumps with the prime mover, and adjusting means for varying the capacity of pumps in at least one pump unit.

The operating means preferably comprises an output member which is driven by the prime mover, and input member for the pumps of each pump unit, and means for transmitting motion from the output member to the input members. Such apparatus can further comprise a housing for the pump units, and the housing preferably comprises a first section for the first pumps of the pump units and a second section for the second pumps of the pump units. The two sections of the housing are preferably spaced apart from one another, and the motion transmitting means of the operating means can be disposed in the space between the two sections of the housing. The output member is preferably reciprocable, and the sections of the housing can comprise guide means for portions of the output member. The prime mover is preferably disposed at that side of one of the housing sections which faces away from the other housing section.

The first pumps are or can be diaphragm pumps having a common diaphragm in the first section of the housing, and the second pumps are or can be diaphragm pumps having a common diaphragm in the second section of the housing.

Each section of the housing can define a tank for a supply of hydraulic working fluid which is used to operate the pumps in the respective section, and means for admitting fluid from the tanks to the pumps in the respective sections as well as for permitting fluid to flow back from the pumps into the respective tanks. Such admitting means can include openings which are provided in the sections of the housing and valves which control the timing of the flow of fluid between the tanks and the respective pumps.

The adjusting means can be disposed in the space between the two sections of the housing and is accessible for actuation by an attendant and/or for inspection and repair.

The input member for the pumps of the one pump unit preferably comprises two coaxial components, one for the first pump and the other for the second pump of the one pump unit. The adjusting means of such apparatus can comprise means for moving the two components axially toward or away from each other to thereby alter the capacities of the respective pumps. The moving means can comprise right-hand threads on one of the components, left-hand threads on the other component, and a sleeve having right-hand threads mating with the threads of the one component and left-hand threads mating with the threads of the other component. The sleeve is rotatable in two directions to thereby move the two components toward or away from each other. The sleeve can be replaced with a member having external right-hand threads and external left-hand threads if the components have internal threads Still further, the sleeve or an analogous member can have internal threads mating with external threads of one component and external threads mating with internal threads of the other component.

Each component can be provided with a plunger and each pump of the one pump unit can further comprise a cylinder defining a cylinder chamber for the respective plunger. Such apparatus can further comprise the aforementioned tank or tanks for a supply of hydraulic working fluid, and the cylinders have openings which establish communication between the tank or tanks and the respective cylinder chambers in those axial positions of the plungers which are selected by the adjusting means. Sealing means (e.g., one or more O-rings) can be interposed between the plungers and the respective cylinders.

Each component of the input member for the one pump unit can have a limited freedom of axial movability relative to the respective plunger. The components and the plungers of such apparatus have confronting end faces which abut each other to shift the plungers in the respective cylinders during predetermined stages of movement of the respective components in a first direction (e.g., to expel metered quantities of liquid from the respective pumps). Each pump of the one unit in such apparatus further comprises means for entraining the respective plunger during a predetermined first stage of movement of the corresponding component counter to the one direction. Such apparatus can further comprise a valve between each cylinder chamber and the respective opening, and the valves are arranged to permit the flow of hydraulic liquid between the tank or tanks and the cylinder chambers when the confronting end faces of the components and the respective plungers are out of contact with one another during predetermined second stages of movement of corresponding components counter to the one direction.

The entraining members can comprise resilient elements which are interposed between the plungers and the respective components. Such apparatus can further comprise stops which serve to arrest the plungers upon completion of movement of first stages of movement of the respective components counter to the one direction.

In accordance with a modification, each pump of the one unit comprises a mobile pumping element (e.g., a diaphragm) which serves to draw liquid into and to expel liquid from the respective pump in response to reciprocation of the input member for the one pump unit. Such apparatus comprises resilient restoring means (e.g., coil springs) for biasing the pumping elements in directions to draw liquid into the respective pumps. The components have means for mechanically moving (e.g., propelling) the respective pumping elements against the opposition of the respective restoring means. The means for mechanically moving can comprise dampers, e.g., blocks or pads of elastomeric material.

At least one of the pumps can constitute a diaphragm pump wherein a pumping element in the form of a diaphragm moves back and forth in order to draw liquid from a source into the pumping chamber in response to movement in a first direction and to expel the liquid from the pumping chamber in response to movement in a second direction counter to the first direction. Each diaphragm pump can be of conventional design.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
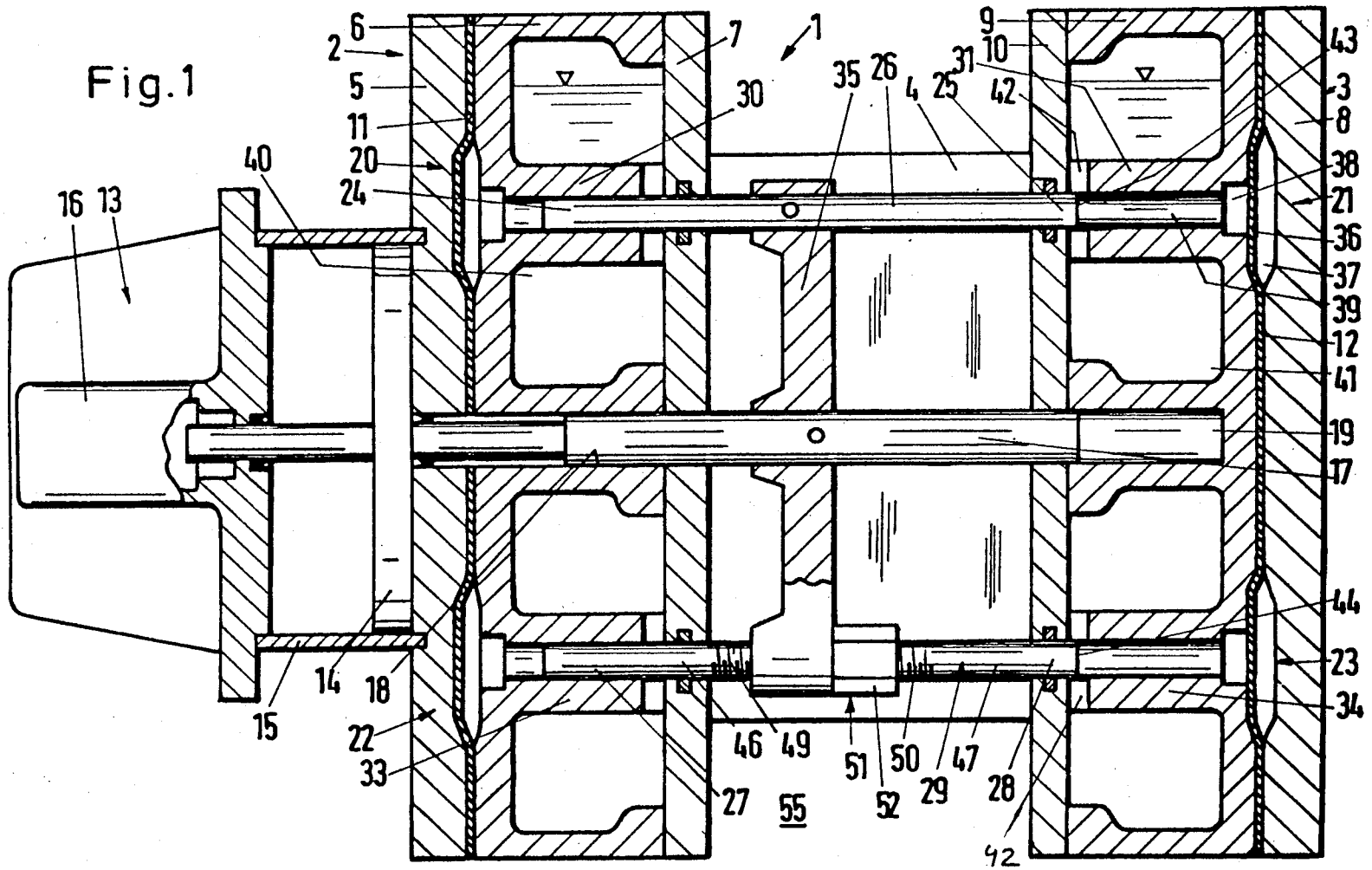
FIG. 1 is a longitudinal sectional view of a portion of a first pumping apparatus with two pumping units each of which comprises two diaphragm pumps, the apparatus having means for adjusting the capacities of pumps in one of the units.

FIG. 1 shows a pumping apparatus which embodies one form of the invention and comprises a housing 1 having a first hollow section 2 and a second hollow section 3 which is or can be a mirror image of the section 2. The two sections are spaced apart from and are connected to each other by a plate-like or otherwise configurated base 4 of the housing 1. The section 2 comprises an outer wall 5 which is remote from the section 3, an intermediate part 6, and an inner wall 7 which faces the section 3. Analogously, the section 3 comprises an outer wall 8, an intermediate part 9 and an inner wall 10 which faces the section 2. The wall 5 of the section 2 cooperates with the intermediate part 6 to clamp selected portions of a first flexible sheet-like diaphragm 11, and the wall 8 of the section 3 cooperates with the intermediate part 9 to clamp selected parts of a second flexible sheet-like diaphragm 12.

The apparatus further comprises a prime mover 13 in the form of a pneumatic axial piston motor which is outwardly adjacent the wall 5, i.e., the motor is disposed at that side of the section 2 which faces away from the section 3. The piston 14 of the motor 13 is reciprocable in a stationary cylinder 15 and its reciprocatory movements are controlled by a direction reversing unit 16 of known design which serves to alternatingly admit a pressurized gaseous fluid (e.g., air) to opposite sides of the piston 14 so that the piston reciprocates an elongated output member 17 at a selected frequency which can be varied in a manner not forming part of the present invention. Portions of the output member 17 are reciprocable in guides 18 and 19 which are respectively provided in the sections 2 and 3 of the housing.

The housing 1 serves to confine two pump units or pumping units one of which comprises two diaphragm pumps 20, 21 (one in the section 2 and the other in the section 3) and the other of which also comprises two diaphragm pumps 22, 23 (one in the section 2 and the other in the section 3). The pumps of each unit are connected in parallel and operate alternatingly, i.e., the pump 20 or 22 delivers a stream of corresponding liquid when the pump 21 or 23 is idle, and vice versa.

The output member 17 constitutes one element of the means for operating the pumps 20–23, namely for connecting the prime mover 13 with the mobile parts of the individual pumps, and such operating means further comprises a first input member 26 for the pumps 20, 21, a second input member 29 for the pumps 22, 23 and a yoke-like motion transmitting member 35 which is disposed in the space 55 between the housing sections 2, 3 and connects the output member 17 with the input members 26, 29. The input member 26 comprises two liquid displacing plungers 24, 25 (for the pumps 20, 21, respectively), and the input member 29 comprises two liquid displacing plungers 27, 28 (for the pumps 22, 23, respectively). The plungers 24, 25 and 27, 28 are respectively reciprocable in cylinders 30, 31 and 33, 34. The cylinders 30, 33 are integral with the intermediate part 6 of the housing section 2, and the cylinders 31, 34 are integral with the intermediate part 9 of the housing section 3. The input member 26 can constitute a one-piece rod a median portion of which is connected to the motion transmitting member 35. The input member 29 is a two-piece rod (having coaxial components or portions 46, 47) which is indirectly connected to the motion transmitting member 35.

The diaphragm pump 21 in the housing section 3 comprises a pumping element 36 which constitutes a portion of the diaphragm 12, a pumping chamber 37 at one side of the pumping element 36, a working chamber 38 which is disposed at the other side of the pumping element 36 and is filled with a body of hydraulic fluid, the aforementioned plunger 25 of the input member 26, and the aforementioned cylinder 31 which is integral with the intermediate part 9 of the housing section 3 and defines a cylinder chamber 39 forming part of the working chamber 38 and confining the plunger 25 to reciprocatory movements toward and away from the pumping element 36.

When the plunger 25 performs a forward (rightward) stroke, hydraulic fluid in the working chamber 38 reduces the volume of the pumping chamber 37 through the medium of the deformable pumping element 37 (see the pumps 20 and 22). Inversely, when the plunger 25 performs a return or suction stroke to draw the pumping element 36 away from the wall 8 due to a reduction of pressure in the working chamber 38, the volume of the pumping chamber 37 increases, i.e., the pump 21 draws a metered quantity of the respective liquid into its chamber 37 for expulsion during the next-following forward stroke of the plunger 25. The pumping elements of the pumps 21 and 23 are shown in positions they assume when the respective pumping chambers 37 are filled with liquid.

The construction of the pumps 20, 22 and 23 is or can be identical with that of the just described pump 21.

The intermediate part 6 and the inner wall 7 of the housing section 2 define a first tank 40 which is common to the cylinder chambers 39 of the pumps 20, 22 and contains a supply of hydraulic fluid. A similar tank 41 is defined by the inner wall 10 and the intermediate part 9 of the housing section 3 to accommodate a reasonably large supply of hydraulic fluid for the cylinder chambers 39 of the pumps 21 and 23. The cylinders 30, 31 and 33, 34 have openings in the form of radially extending holes or bores 42 which can admit hydraulic fluid from the respective tanks 40, 41 into the cylinder chambers 39 when the corresponding plungers 24, 25, 27, 28 are sufficiently retracted to allow for the establishment of communication between the openings 42 and the respective cylinder chambers 39. FIG. 1 shows the plungers 25, 28 in retracted positions in which the corresponding openings 42 allow hydraulic fluid to flow from the tank 41 into the corresponding cylinder chambers 39. At the same time, the plungers 24, 27 seal the respective openings 42 from the adjacent cylinder chambers 39 so that these chambers are sealed from the tank 40. The openings 42 invariably communicate with the respective cylinder chambers 39 when the corresponding plungers assume their fully retracted positions (i.e., when such plungers complete their suction or return strokes).

The rate at which the plunger 24 permits hydraulic fluid to flow from the tank 41 into the respective chamber 39 may but need not be the same as the rate of admission of hydraulic liquid from the tank 41 into the cylinder chamber 39 for the plunger 28. In fact, FIG. 1 shows that the axial position of the plunger 25 is not the same as that of the plunger 28; the front end face 43 of the plunger 25 will seal the opening 42 from the chamber 39 prior to sealing of the opening 42 from the tank 41 by the front end face 44 of the plunger 28. Thus, the selected capacity of the pump 23 is smaller than that of the pump 21.

The capacity of the pumps 22, 23 can be changed jointly by an adjusting means 51 which is installed in the space 55 between the housing sections 2, 3 and is accessible to an operator wishing to increase or reduce the capacity of the pumps 22, 23. As mentioned above, the input member 29 comprises two coaxial portions or components 46, 47 which respectively carry the plungers 27, 28 for the pumps 22 and 23. The adjusting means 51 comprises left-hand threads 49 at that end of the portion 46 which is remote from the plunger 27 and right-hand threads 50 at that end of the portion 47 which is remote from the plunger 28. The adjusting means 51 further comprises a sleeve 52 which has a hexagonal or other polygonal outline so that it can be readily rotated by a commercially available tool (not shown) and is provided with internal threads 53, 54 (see FIG. 3) respectively mating with the left-hand threads 49 and right-hand threads 50. The portions 46 and 47 are non-rotatably but reciprocably mounted in the respective housing sections 2, 3 and the sleeve 52 is rotatably mounted in the motion transmitting member 35 so that, when the sleeve is rotated by a suitable tool, the portions 46 and 47 of the input member 29 move axially toward or away from each other, depending on the selected direction of rotation of the sleeve 52. The arrangement is, or can be, such that the capacity of the pump 22 is changed at the same rate as that of the pump 23 when the operator decides to rotate the sleeve 52 in a clockwise or in a counterclockwise direction.

If it is desired to change the overall quantities of liquids which are respectively delivered by the units 20, 21 and 22, 23, the operator will adjust a flow restrictor (not shown) which regulates the rate of flow of pressurized fluid to the chambers in the cylinder 15 of the prime mover and/or by increasing or reducing the stroke of the piston 14, e.g., by means of suitable stops (not shown) which can be shifted relative to the cylinder 15.

Figure 2:
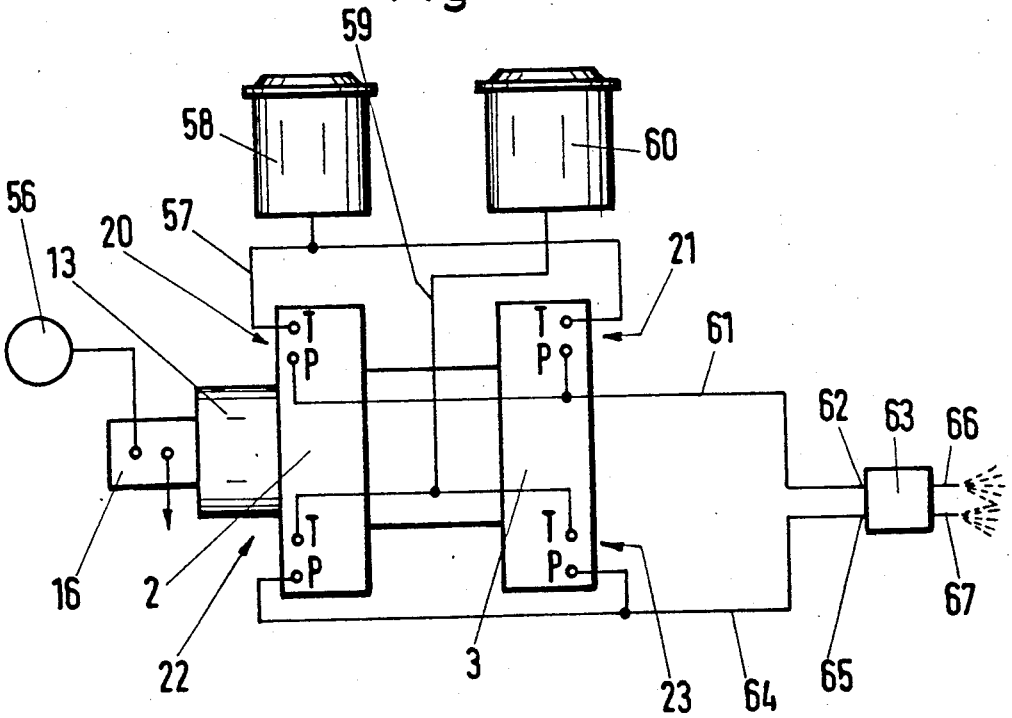
FIG. 2 is a diagrammatic view of the pumping apparatus which embodies the structure of FIG. 1.

FIG. 2 shows schematically the entire apparatus which includes the pumping units 20, 21 and 22, 23 of FIG. 1. The reversing unit 16 for the piston 14 of the prime mover 13 receives pressurized fluid (e.g., compressed air) from a suitable source 56. The suction intakes T of the pumps 20, 21 are connected with a reservoir 58 by conduits 57, and the suction intakes T of the pumps 22, 23 are connected with a second reservoir 60 by conduits 59. The reservoir 58 contains a supply of liquid which is to be delivered by the pumps 20, 21, and the reservoir 60 contains a supply of liquid which is to be delivered by the pumps 22, 23. The outlets P of the pumps 20, 21 deliver pressurized liquid to the inlet 62 of a spraying device 63 by way of conduits 61, and the outlets P of the pumps 22, 23 deliver pressurized liquid to the inlet 65 of the spraying device 63 by way of conduits 64. It will be seen that the conduits 61 connect the outlets P of the pumps 20, 21 in parallel and the conduits 64 connect the outlets P of the pumps 22, 23 in parallel. The spraying device 63 has a first nozzle (or a first set of nozzles) 66 for liquid which is supplied by the reservoir 58, and a second nozzle (or a set of second nozzles) 67 for liquid which is supplied by the reservoir 60. The sprays which issue from the nozzles 66, 67 are mixed on their way toward impingement upon a surface to be coated as well as subsequent to such impingement.

An important advantage of the improved apparatus is that the pumps of each pumping unit operate alternatingly, i.e., that the pump 20 delivers a first liquid while the chamber 37 of the pump 21 is in the process of receiving the first liquid and vice versa, and that the pump 22 delivers a second liquid while the chamber 37 of the pump 23 is in the process of being filled with the second liquid and vice versa. This renders it possible to ensure that each of the two liquids is delivered to the spraying device 63 at a substantially constant rate rather than at spaced-apart intervals. Moreover, the ratio of the quantity of first liquid to the quantity of the second liquid can be selected and maintained with a very high degree of accuracy and for any desired interval of time. This is attributable, in part, to the provision of a common prime mover for all four pumps.

Another important advantage of the improved apparatus is that the adjusting means 51 renders it possible to simultaneously change the capacities of the respective pumps 22, 23 to the same extent, i.e., that the stream of second liquid which is admitted to the inlet 65 of the spraying device 63 does not consist of increments containing larger quantities of second liquid and alternating with increments containing smaller quantities of the same liquid. This is often very important, for example, if the ratio at which the two liquids are mixed must be maintained at or very close to a fixed value. Moreover, such construction renders it possible to dispense with a mixing chamber ahead of the spraying device 63, i.e., there is no need to provide for each liquid a zone or chamber wherein the delivered liquid is free to calm down prior to entering the consuming device (63) proper. The exact construction of the device 63 (which can constitute a conventional spray gun) forms no part of the present invention. In the embodiment of FIGS. 1 and 2, initial contact between the two liquids takes place in the spraying device 63, in the region downstream of the orifices of the nozzles 66, 67 and/or after impingement of the two sprays upon a surface to be coated.

The feature that the prime mover 13 is disposed at the outer side of the wall 5 and the motion transmitting member 35 as well as the adjusting means 51 are disposed in the space 55 between the sections 2 and 3 of the housing 1 contributes to compactness of the apparatus and renders it possible to gain access to all such components which require attention. The utilization of two diaphragms (11, 12) each of which constitutes the pumping elements (36) of several individual pump also contributes to compactness and lower cost of the apparatus and simplifies the assembly of the pumps 20–23.

The dimensions of the tanks 40 and 41 can be selected practically at will. Thus, each of these tanks can occupy the entire interior of the respective housing section save for the space which is required for the corresponding cylinders (30, 31 and 33, 34) and the guide means 18, 19 for the output member 17.

The plungers 24, 25, 27, 28, the corresponding cylinders 30, 31 and 33, 34, together with the associated tanks 40, 41 and working chambers 38 establish hydraulic connections between the input members 26, 29 and the respective pairs of pumps 20, 21 and 22, 23. The feature that the plungers 27, 28 of such hydraulic connections for the pumps 22, 23 can establish or terminate communication between the working chambers and the respective tanks 40, 41 by the simple expedient of exposing or sealing the openings 42 during selected stages of their axial movement contributes to simplicity of adjustment of the capacities of pumps 22 and 23. Thus, all that is necessary is to properly select those axial positions of the portions or components 46, 47 of the input member 29 in which the front end faces 44 of such portions permit hydraulic fluid to flow between the working chambers 38 of the pumps 22, 3 and the respective tanks 40, 41.

Figure 3:
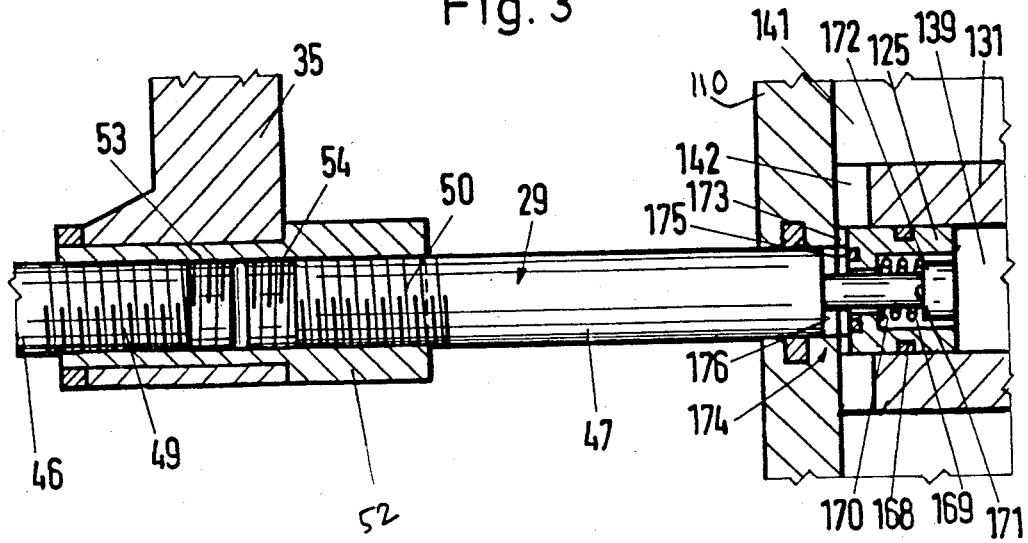
FIG. 3 is a fragmentary sectional view of a second pumping apparatus wherein the plungers of the means for operating the pumps are axially movably connected with the respective output members.

FIG. 3 shows a portion of a modified pumping apparatus. The difference between this apparatus and that of FIGS. 1–2 is that the simple plunger 28 of the pump 23 is replaced with a modified plunger 125 reciprocable in a cylinder 131 corresponding to one of the cylinders 31 in FIG. 1. The peripheral surface of the plunger 125 has a circumferential groove for a ring-shaped sealing element 168, e.g., an O-ring. The plunger 125 is reciprocable, within limits, relative to the portion 47 of the input member 29 under the bias or against the opposition of a resilient element in the form of a coil spring 169 reacting against the shoulder 171 of a head or boss 172 on the portion 47 and bearing against an internal shoulder 170 of the plunger 125. The boss 172 is connected with the portion 47 of the input member 29 by a shank which is surrounded by the coil spring 169. The right-hand side 173 of the inner wall 110 of the housing section which is shown in FIG. 3 serves as a stop for the left-hand or suction stroke of the plunger 125; when the plunger 125 strikes against the side or stop 173, the portion 47 of the input member 29 is free to continue its leftward movement under the action of the motion transmitting member 35 by causing the spring 169 to store energy. This results in the opening of a valve 174 which is disposed between a sealing ring in the end face 175 of the plunger 125 and the end face 176 of the portion 47 of the input member 29. The valve 174 then allows hydraulic fluid to flow between the cylinder chamber 139 and the tank 141.

The plunger 125 is moved in a direction to the right when the portion 47 moves in the same direction and its end face 176 engages the end face 175 of the plunger. When this forward stroke is completed, the boss 172 pulls the plunger 125 in a direction to the left through the medium of the coil spring 169 which operates between the shoulders 170 and 171. The effective forward stroke of the plunger 125 begins only when the rightward axial movement of the input member 29 relative to the plunger 125 (in a direction to the right) is terminated, i.e., when the end face 176 engages the end face 175. The idle stroke of the input member 29 relative to the plunger 125 can be increased or reduced by rotating the sleeve 52 relative to the input member 29. This results in a reduction or in an increase of the capacity of the pump which includes the plunger 125. The other three plungers in the apparatus which embodies the structure of FIG. 3 are or can be identical with the plunger 125.

The feature of establishing a certain amount of lost motion between the portion 47 of the input member 29 and the plunger 125 renders it possible to provide the aforementioned valve 174 which regulates the flow of hydraulic fluid between the interior of the cylinder 131 and the tank 141 (by way of the opening 142). The sealing element 168 practically eliminates leakage of hydraulic fluid around the plunger 125 when the plunger performs its forward strokes so that the selected rate of delivering liquid by the pumps which receive motion from the input member 29 of FIG. 3 remains constant The spring 169 between the shoulders 170, 171 serves to arrest the plunger 125 on its way away from the working chamber before the input member 29 reaches its left-hand end position. This spring ensures that the valve 174 remains closed until the portion 47 of the input member 29 begins to move relative to the plunger 125, i.e., the valve 174 remains closed until after the plunger 125 completes its suction stroke. This renders it possible to return the pumping element (diaphragm) of the pump which is operated by the plunger 125 to its starting position by using one or more weak restoring springs or without the need for any restoring spring or springs.

Figure 4:
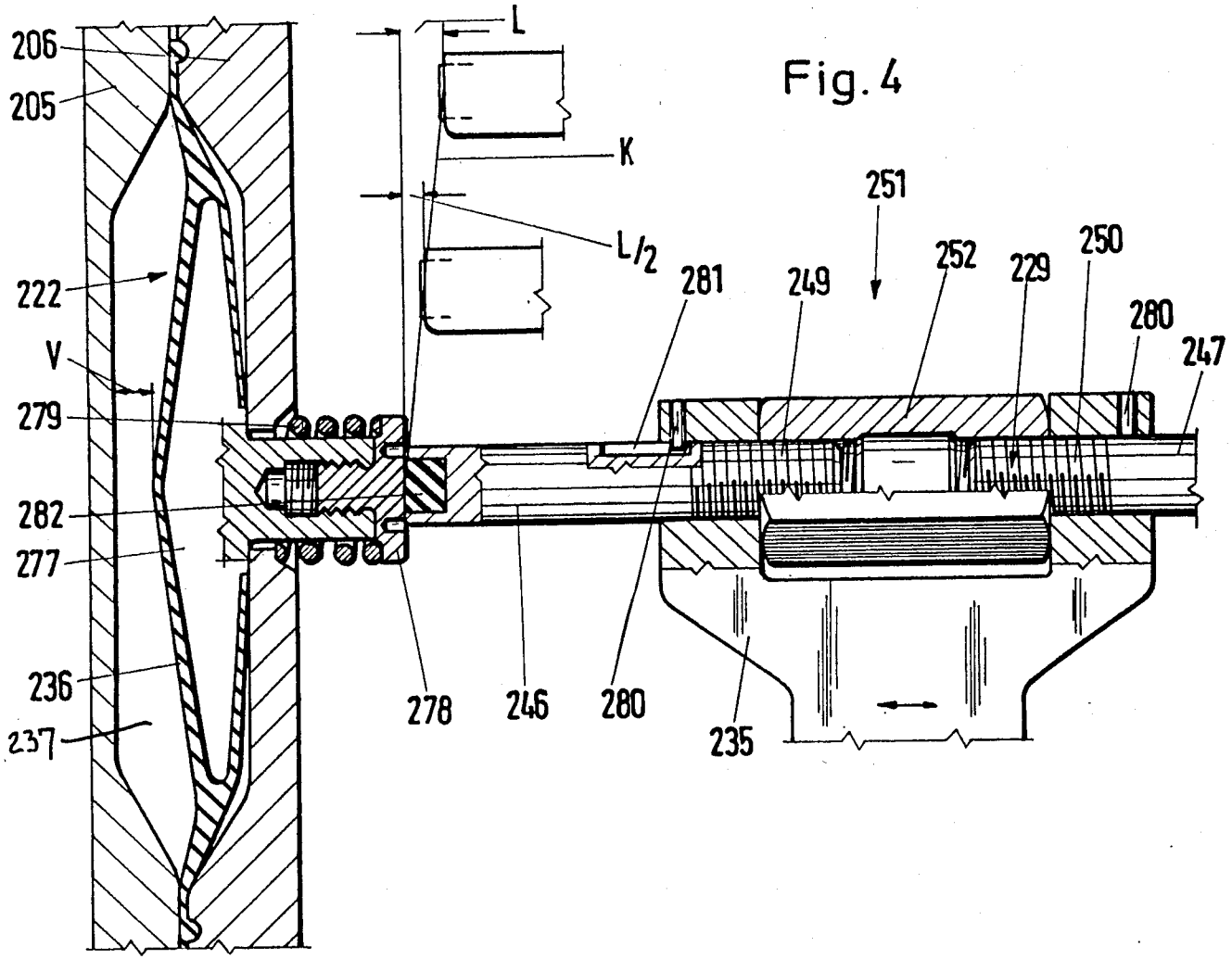
FIG. 4 is a fragmentary sectional view of a third apparatus wherein the output members can be caused to strike directly against the respective pumping elements.

FIG. 4 shows a portion of a third pumping apparatus wherein all parts which are identical with or clearly analogous to the corresponding parts of the apparatus of FIGS. 1–2 are denoted by similar reference characters plus 200. The diaphragm pump 222 of the apparatus of FIG. 4 comprises a pumping element 236 forming part of a sheet-like diaphragm corresponding to the diaphragm 11 of FIG. 1 and disposed between the outer wall 205 and the intermediate part 206 of the housing section shown in FIG. 3. The pumping element 236 is reinforced by an insert 277 which extends to the right beyond the intermediate part 206 and carries a separable abutment 278, e.g., a screw- or bolt-like part which is threadedly connected with the exposed end portion of the insert 277. A restoring element in the form of a coil spring 279 reacts against the intermediate part 206 and bears against the abutment 278 to urge the insert 277 and the pumping element 236 to the right-hand end positions which are shown in FIG. 4.

The input member 229 comprises two coaxial components or portions 246 and 247 which are respectively provided with left-hand threads 249 and right hand threads 250. The sleeve 252 of the adjusting means 251 is rotatably mounted in the motion transmitting member 235 has left-hand threads in mesh with the threads 249 and right-hand threads in mesh with the threads 250 so that the portions 246, 247 move axially toward or away from each other in response to rotation of the sleeve 252 in the respective direction. The motion transmitting member 235 has a bifurcated end portion whose legs flank the sleeve 252. Radially extending pins 280 in the motion transmitting member 235 extend into axially parallel grooves 281 of the portions 246, 247 to prevent rotation of the input member 229 in response to rotation of the sleeve 252. The outer ends of the portions 246, 247 carry elastic dampers or shock absorbers 282 which can strike against the respective abutments 278 to move the corresponding pumping elements 236.

The pump 222 has a discrete diaphragm-like pumping element 236 with a beaded marginal portion clamped between the wall 205 and intermediate portion 206.

In FIG. 4 the input member 229 is shown in fully extended position, i.e., its portions 246, 247 are located at a maximum distance from each other. The dampers 282 (only one can be seen in FIG. 4) are in contact with the respective abutments 278. Thus, when the prime mover 13 (not shown in FIG. 4) is operative, the pumping element 236 of the pump 222 and of the pump which is connected in parallel therewith perform maximum strokes V. If the operator decides to rotate the sleeve 252 in a direction to reduce the effective length of the input member 229, the free end of the portion 246 moves along the line K. The input member 229 must perform an idle stroke prior to displacing the pumping elements 236. A movement of the free end of the portion 246 along the line K results in a reduction of capacity of the respective pumps, i.e., in a reduction of the quantity of liquid which is displaced by the pumps during each forward stroke. When the stroke of the portion 246 is reduced by the distance L (as shown in the upper part of FIG. 4), the capacity of the pump 222 is reduced to zero. The distance L equals V. When the stroke of the portion 246 is reduced by L/2, the capacity of the pump 222 is reduced in half. The same applies for the other pump which includes the plunger at the outer end of the right-hand portion 247 of the input member 229.

It will be seen that the apparatus of FIG. 4 relies on a mechanical connection between the pumping element 236 of the pump 222 and the input member 229. This is made possible by the simple expedient of providing the restoring spring 279 which moves the pumping element 236 back to the position of FIG. 4 as soon as the portion 246 of the input member 229 is sufficiently retracted to allow for requisite expansion of (i.e., dissipation of energy by) the spring 279. The portion 246 is in mere force-locking engagement with the abutment 278 when the pumping element 236 is caused to expel a metered quantity of the respective liquid from the pumping chamber 237 of the pump 222.

The provision of the damper 282 (e.g., a simple block of rubber or the like) is desirable and advantageous in order to reduce the likelihood of generation of excessive or noticeable noise.

Figure 5:
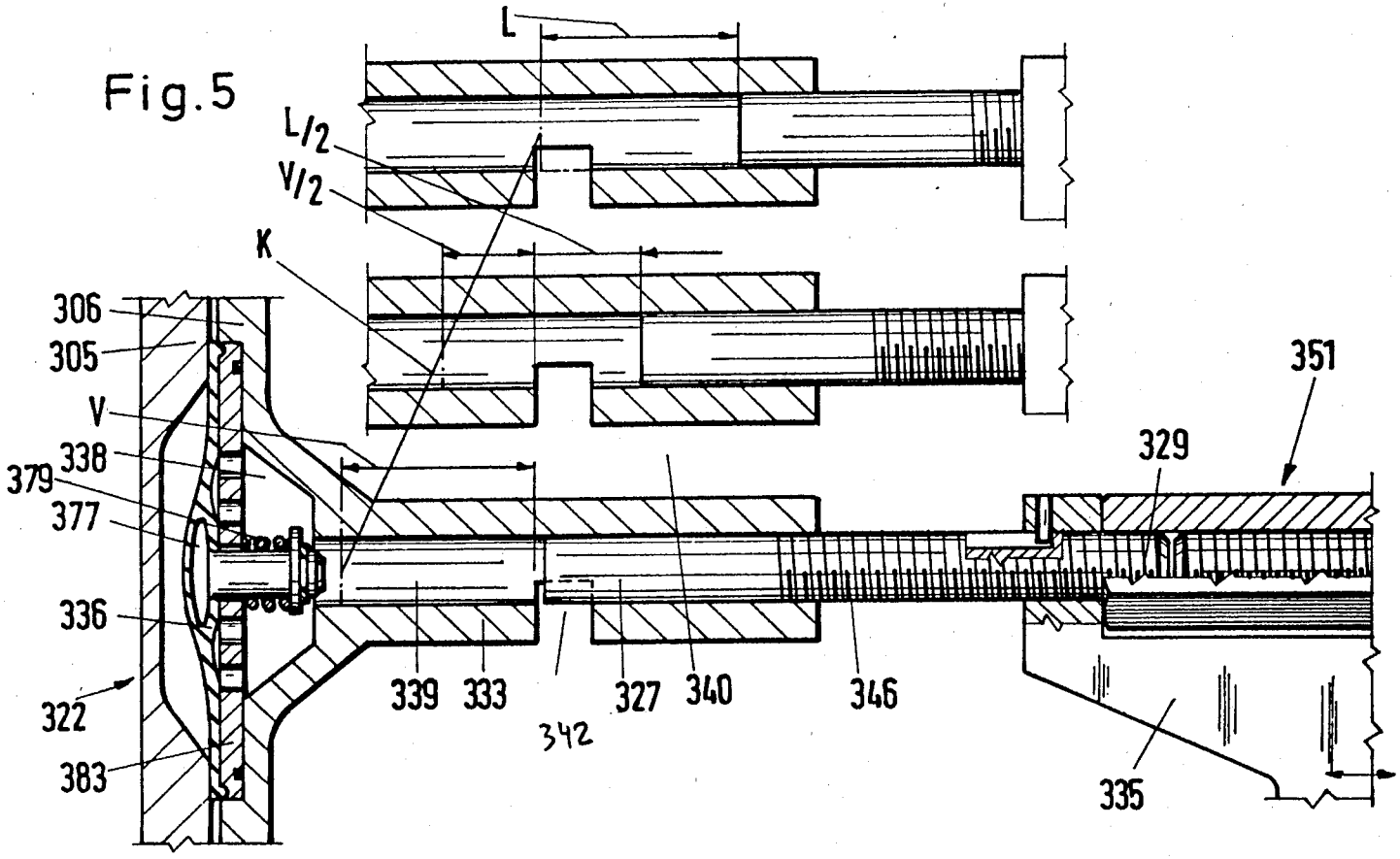
FIG. 5 is a fragmentary sectional view of a fourth apparatus which constitutes a modification of the apparatus of FIG. 1.

Referring to FIG. 5, there is shown a portion of a fourth pumping apparatus wherein all parts which are identical with or analogous to those of the apparatus of FIGS. 1–2 are denoted by similar reference characters plus 300. The pumping element 336 of the pump 322 comprises a restoring spring 37 tending to maintain the pumping element in the right-hand end position (shown in FIG. 5) in which the median portion of the pumping element 336 abuts a plate-like stop 383 between the outer wall 305 and the intermediate part 306 of the housing section which is shown in FIG. 5. A hydraulic connection is provided between the input member 329 and the pumping element 336. When the portion 346 of the input member 229 covers the full distance from the illustrated (retracted) end position to the other end position, the pumping element 336 performs a stroke V which corresponds to the maximum capacity of the pump 322. The adjusting means 351 can be actuated in the aforedescribed manner to change the capacity of the pump 322 by shortening the extent of axial displacement of the portion 346 of the input member 329. The plunger 327 then moves along the line K through a distance L (if the capacity of the pump 322 is to be reduced to zero) or through a different distance (for example, L/2) to reduce the stroke of the pumping element 336 to a corresponding value (V/2). When the stroke of the portion 346 is reduced by the distance L, the plunger 327 does not advance beyond the opening 342 so that the working chamber 338 is in uninterrupted communication with the tank 340 in the housing section which is shown in FIG. 5. The capacity of the right hand pump (not shown) which is connected in parallel with the pump 322 is changed in the same way.

Figure 6:
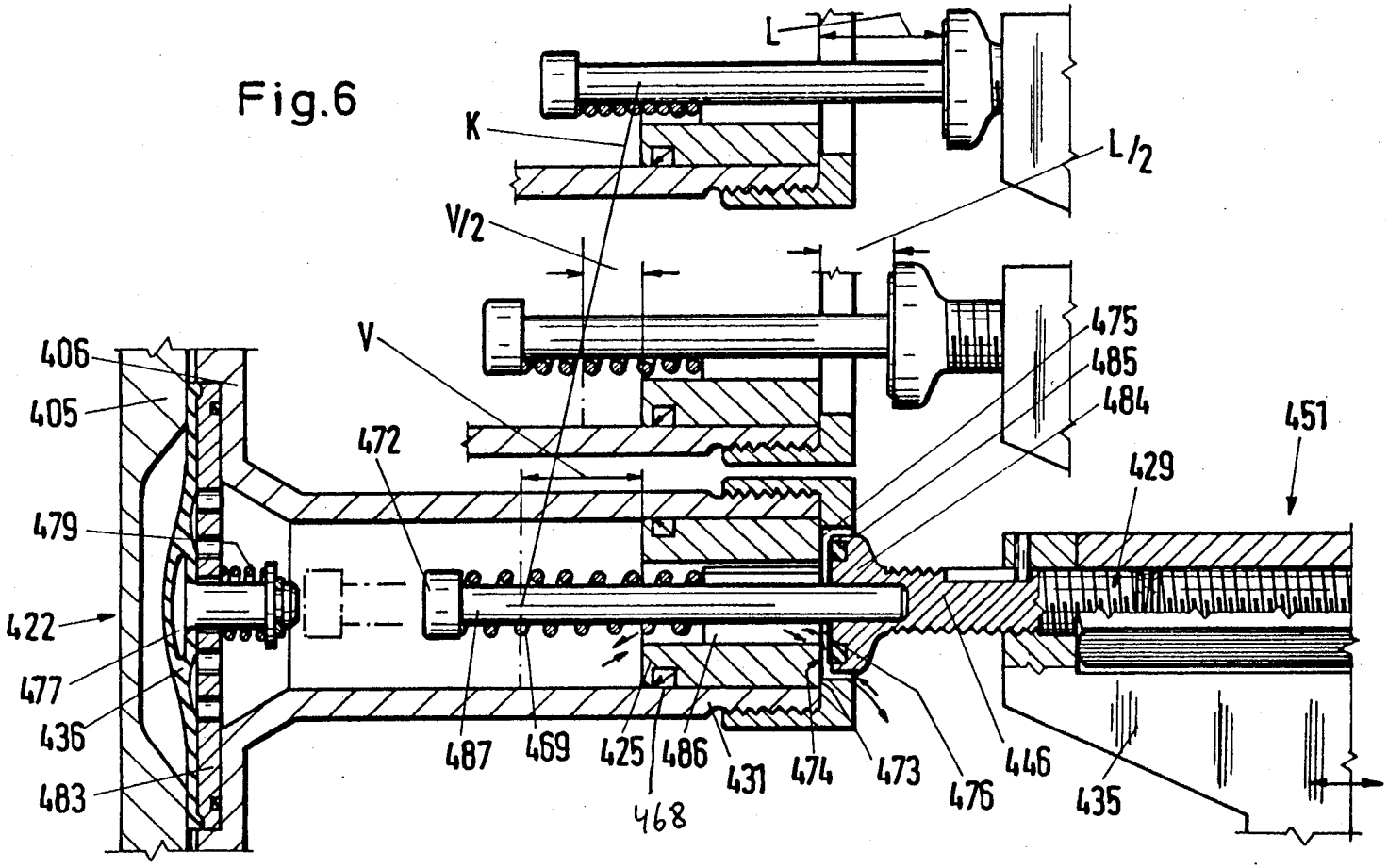
FIG. 6 is a fragmentary sectional view of a fifth apparatus which constitutes a modification of the apparatus of FIG. 3.

FIG. 6 shows a portion of a fifth pumping apparatus wherein all parts which are identical with or clearly analogous to the corresponding parts of the apparatus of FIGS. 1–2 are denoted by similar reference characters plus 400. The two portions (only the portion 446 is shown) of the input member 429 are provided with valving elements 484 which have front end faces provided with annular grooves for sealing rings 485. The illustrated valving element 484 cooperates with the end face (seat) 475 of the plunger 425 to form a valve 474. The portion 446 of the input member 229 carries a rod-like extension or shank 487 which has a set of ribs 486 guided in the axial passage of the plunger 425. The boss 472 is provided at the free end of the extension 487 and is biased by the spring 469.

When the input member 429 has an effective length as shown in the lower part of FIG. 6, its idle stroke is negligible. At such time, the boss 472 can perform strokes V of maximum length and the pump 422 operates at a maximum capacity. By rotating the sleeve of the adjusting means 451, the operator can move the boss 472 along the line K through a distance L (so that the capacity of the pump 422 is reduced to zero) or through a different distance (e.g., L/2) so that the stroke of the pumping element 436 is reduced accordingly (see the stroke V/2).

The improved pumping apparatus can be modified in a number of additional ways without departing from the spirit of the invention. For example, and referring again to FIGS. 1, 2 and 3, the capacity of the pumps 22 and 23 can be changed by employing an input member 29 of fixed length if the positions of the cylinders 33, 34 (and their openings 42) can be changed in the axial direction of the input member 29. It is also possible to employ an input member 29 of variable length in conjunction with cylinders 33, 34 which are movable axially toward and away from each other. The means for adjusting the positions of the cylinders 33, 34 relative to each other and relative to the respective housing sections 2, 3 can be disposed in the space 55 and can be similar to the adjusting means 51 so as to allow for a movement of the cylinders 33, 34 toward or away from each other in response to manipulation of a single sleeve, muff, nut or the like.

Furthermore, the illustrated prime mover 13 constitutes but one of numerous motors which can be used to reciprocate the output member 17 and the input members 26, 29. For example, the prime mover 13 can be replaced with a motor having an eccentric which serves to move the output member 17 or the motion transmitting member 35 back and forth.

The illustrated pumps 20–23 can be replaced with other types of pumps, e.g., with pumps employing disc-shaped pumping elements.

The number of pumping units can be increased to three or more, depending on the number of different liquids which are to be mixed and/or otherwise applied at a predetermined rate and in predetermined percentages. For example, if the number of pumping units is increased to three or more, the corresponding input members (including the input members 26, 29 of FIG. 1) can be assembled into an array of parallel input members which are equidistant from and surround an output member (17). The motion transmitting member 35 is then replaced with a member having three or more bifurcated arms, one for each input member, i.e., one for each pumping unit.

The improved apparatus can comprise adjusting means for each of the pumping units. With reference to FIG. 1, the apparatus which is shown therein can comprise second adjusting means 51 for the input member 26.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for simultaneous delivery of metered quantities of a plurality of liquids, comprising a plurality of pump units, at least one for each liquid and each comprising a first and a second pump, the first and second pumps of each unit being arranged to operate alternatingly and being connected in parallel; a prime mover; operating means for connecting said pumps with said prime mover, including a reciprocable input member arranged to operate the first and second pumps of at least one of said units and including coaxial first and second components operatively connected to the first and second pumps of said at least one unit with freedom to perform idle strokes relative to the respective pumps; and adjusting means for simultaneously varying the capacity of pumps in said at least one unit to the same extent, including means for moving said components axially toward and away from each other to thereby vary the idle strokes and hence the capacity of pumps in said at least one unit.

2. The apparatus of claim 1, wherein said operating means further comprises an output member driven by said prime, mover, an input member for the pumps of another of said units, and means for transmitting motion from said output member to said input members.

3. The apparatus of claim 2, further comprising a housing for said units, said housing having a first section for said first pumps and a second section for said second pumps, said sections being spaced apart from one another and said motion transmitting means being disposed between said sections.

4. The apparatus of claim 3, wherein said output member is reciprocable and said sections comprise guide means for portions of said output member.

5. The apparatus of claim 3, wherein said first pumps are diaphragm pumps having a common diaphragm in said first section.

6. The apparatus of claim 3, wherein said second pumps are diaphragm pumps having a common diaphragm in said second section.

7. The apparatus of claim 3, wherein each of said sections defines a tank for a supply of a hydraulic fluid and means for admitting hydraulic fluid from the tanks to the pumps in the respective sections.

8. The apparatus of claim 1, further comprising a housing for said units, said housing including a first section for said first pumps and a second section for said second pumps, said sections being spaced apart from each other and said adjusting means being disposed between said sections and being accessible for adjustment of the capacities of first and second pumps in said one unit as a result of adjustment of idle strokes of said components 9. The apparatus of claim 1, wherein said moving means comprises right hand threads on one of said components, left-hand threads on the other of said components, and a sleeve having right-hand threads mating with the threads of said one component and left-hand threads mating with the threads of said other component, said sleeve being rotatable in two directions to thereby move said components toward or away from each other.

10. The apparatus of claim 1, wherein each of said components is provided with a plunger and each pump of said one unit comprises a cylinder defining a cylinder chamber for the respective plunger, and further comprising at least one tank containing a supply of hydraulic working fluid, said cylinders having openings which establish communication between said tank and the respective cylinder chambers in those axial positions of said plungers which are selected by said adjusting means.

11. The apparatus of claim 10, further comprising sealing means interposed between said plungers and the respective cylinders.

12. The apparatus of claim 1, wherein each pump of said one unit comprises a mobile pumping element arranged to draw liquid into and to expel the drawn liquid from the respective pump in response to reciprocation of said input member, and resilient restoring means for biasing said pumping elements in directions to draw liquid into the respective pumps, said components having means for mechanically moving the respective pumping elements against the opposition of said restoring means 13. The apparatus of claim 12, wherein said means for mechanically moving comprises dampers 14. The apparatus of claim 1, wherein at least one of said pumps is a diaphragm pump.

15. The apparatus of claim 10 wherein said components are arranged to seal the respective openings in response to completion of their idle strokes.

16. Apparatus for simultaneous delivery of metered quantities of a plurality of liquids, comprising a plurality of pump units, at least one for each liquid and each comprising a first and second pump, the first and second pumps of each unit being arranged to operate alternatingly and being connected in parallel; a housing for said units, said housing having a first section for said first pumps and a second section for said second pumps, said sections being spaced apart from one another; a prime mover, one of said sections having a side facing away from the other of said sections and said prime mover comprising a motor at said side of said one section; operating means for connecting said pumps with said prime mover, comprising an output member driven by said prime mover, an input member for the pumps of each unit, and means for transmitting motion from said output member to said input members, said motion transmitting means being disposed between said sections; and adjusting means for varying the capacity of pumps in at least one of said units.

17. Apparatus for simultaneous delivery of metered quantities of a plurality of liquids, comprising a plurality of pump units, at least one for each liquid and each comprising a first and a second pump, the first and second pumps of each unit being arranged to operate alternatingly and being connected in parallel; a prime mover; adjusting means for varying the capacity of pumps in at least one of said units; operating means for connecting said pumps with said prime mover, comprising a reciprocable input member arranged to operate the first and second pumps of said one unit and including coaxial first and second components operatively connected with the first and second pumps of said one unit, said adjusting means including means for moving said components axially toward and away from each other and each of said components being provided with a plunger, each pump of said one unit comprising a cylinder defining a cylinder chamber for the respective plunger and each of said components having limited freedom of axial movability relative to the respective plunger, said components and said plungers having confronting end faces which abut each other to shift the plungers in the respective cylinders during predetermined stages of movement of the respective components in a first direction, each pump of said one unit further comprising means for entraining the respective plunger during a predetermined first stage of movement of the corresponding component counter to said one direction; and at least one tank containing a supply of hydraulic working fluid, said cylinders having openings which establish communication between said tank and the respective cylinder chambers in those axial positions of said plungers which are selected by said adjusting means.

18. The apparatus of claim 17, further comprising a valve provided between each of said cylinder chambers and the respective openings, said valves being arranged to permit the flow of hydraulic fluid between said tank and said cylinder chambers when the confronting end faces of said components and the respective plungers are out of contact with one another during predetermined second stages of movement of the corresponding components counter to said one direction.

19. The apparatus of claim 17, wherein said entraining means comprise resilient elements interposed between said plungers and the respective components.

20. The apparatus of claim 17, further comprising stops arranged to arrest said plungers upon completion of first stages of movement of the respective components counter to said one direction.

21. Apparatus for simultaneous delivery of metered quantities of a plurality of liquids, comprising a plurality of pump units, at least one for each liquid and each comprising a first and a second pump, the first and second pumps of each unit being arranged to operate alternatingly and being connected in parallel; a housing for said units, said housing having a first section for said first pumps and a second section for said second pumps; a prime mover; operating means for connecting said pumps with said prime mover, including an axially reciprocable output member driven by said prime mover, axially reciprocable input members for the first and second pumps of said units, each of said input members comprising coaxial first and second components operatively connected to the respective first and second pumps with freedom to perform idle strokes relative to the respective pumps, and means for transmitting motion from said output member to said input members, said sections being spaced apart from one another and comprising guide means for said output member and said input members, said motion transmitting means being disposed between said sections and said input members being equidistant from said output member; and adjusting means for simultaneously varying the capacity of pumps in at least one of said units to the same extent, including means for moving the respective components axially toward and away from each other to thereby vary the idle strokes and hence the capacity of pumps in said at least one unit.

* * * * *